United States Patent [19]

Langouët

[11] Patent Number: 4,570,451

[45] Date of Patent: Feb. 18, 1986

[54] PRESSURE-RATIO THRESHOLD SENSOR AND A MACHINE PROCESSING A LIQUEFIABLE GAS AND EQUIPPED WITH SUCH A SENSOR

[75] Inventor: Luc Langouët, Bridgeport, Conn.

[73] Assignee: Bernard Zimmern, East Norwalk, Conn.

[21] Appl. No.: 598,929

[22] Filed: Apr. 10, 1984

[30] Foreign Application Priority Data

Apr. 14, 1983 [FR] France ..... 83 06080

[51] Int. Cl.[4] ..... F25B 1/00

[52] U.S. Cl. ..... 62/228.3; 62/209; 62/228.5

[58] Field of Search ..... 62/228.1, 228.5, 228.3, 62/229, 226, 227, 208, 209, 210, 215, 196.1, 196.2; 236/1 EA

[56] References Cited

U.S. PATENT DOCUMENTS

| | | | |
|---|---|---|---|
| 1,750,336 | 9/1930 | Terry | 62/209 |
| 3,088,659 | 5/1963 | Nilsson et al. | 230/138 |
| 4,221,116 | 9/1980 | Harnish | 62/209 |
| 4,342,199 | 8/1982 | Shaw et al. | 62/228.1 X |
| 4,351,160 | 9/1982 | Kountz et al. | 62/201 |
| 4,362,472 | 12/1982 | Axelsson | 417/53 |

FOREIGN PATENT DOCUMENTS

| | | |
|---|---|---|
| 960087 | 4/1950 | France . |
| 1501105 | 10/1967 | France . |
| 2198104 | 3/1974 | France . |
| 572302 | 10/1945 | United Kingdom . |

OTHER PUBLICATIONS

Althouse et al., *Modern Refrigeration and Air Conditioning*, The Goodheart-Willcox Company, Inc. South Holland, Ill., 1979, pp. 150–151.

*Primary Examiner*—Harry Tanner

*Attorney, Agent, or Firm*—Ziems, Walter & Shannon

[57] ABSTRACT

A membrane innerly divides a body in two rooms, one of which is subjected to a first pressure of the ratio of pressures which is to be compared to a threshold. In the other room, there is a gas in pressure equilibrium with its condensate; this gas is in thermal contact with another gas which is also in pressure equilibrium with its condensate and which is subjected to the second pressure of the pressure ratio. The forces on the membrane balance each other when the ratio equals the threshold. The threshold is equal to the ratio between the pressure of the two gases in equilibrium with their condensate. This threshold is substantially stable when the temperature varies. The membrane is connected to control means.

3 Claims, 3 Drawing Figures

PRESSURE-RATIO THRESHOLD SENSOR AND A MACHINE PROCESSING A LIQUEFIABLE GAS AND EQUIPPED WITH SUCH A SENSOR

This invention relates to a sensor for comparing to a certain threshold the ratio between two pressures, one at least of which is applied to a gas in pressure equilibrium with its vapour.

This invention also relates to a machine equipped with such a sensor.

BACKGROUND OF THE INVENTION

One of the important operating parameters of refrigeration or air conditioning systems using a compressor is the compression ratio, i.e. the ratio of the pressures between upstream and downstream of the compressor, between intake and discharge.

This ratio, which will be designated in the course of this text by the letter "r" defines indeed one of the major thermodynamic characteristics of the cycle, governing in particular the thermodynamic efficiency.

Especially in rotating volumetric compressors, such as vane or screw compressors, normally associated with a fixed built-in compression ratio, the efficiency decreases rapidly when the system compression ratio differs significantly from the built-in one.

By "built-in compression ratio", we mean the pressure ratio determined by the geometry of the compressor itself. By "system compression ratio", we mean the ratio between the exhaust pressure and the intake pressure. These ratios are generally different, the system compression ratio depending on what is connected to intake and to the exhaust of the compressor. As an explanatory example, if the intake and the exhaust would be both connected to the atmosphere, the system ratio would be nearly equal to one.

Thus, different devices have been conceived, such, for instance, as those disclosed in U.S. Pat. No. 3,088,659, to allow varying at leisure the built-in compression ratio so as to make it come near the ratio encountered during operation.

A simple case of implementation consists in providing a machine not with an infinity of compression ratios, which requires complex and costly devices such as shown, for example, in FRG application No. 3,143,193 or in U.S. Pat. No. 4,362,472, but only two ratios.

The implementation is indeed very easy as for instance a simple piston, capable of assuming two positions, actuates the compression ratio control slide visible on FIG. 1 of U.S. Pat. No. 3,088,659; each position corresponds to one of both selectable built-in compression ratios. This arrangement, though not as perfect as a device providing an infinity of compression ratios, results in efficiencies within 2% of the ideal solution with a range of compression ratios between 2,5 and 6, whereas the losses can reach 8 to 10% when the compressor relies upon only one built-in compression ratio.

The problem is then to provide a measuring device allowing to "read" the system compression ratio and, from this reading, to give the necessary instructions, i.e. for example to set or to cancel the pressure on the piston actuating the built-in ratio adjusting means.

Various devices have been conceived or may be conceived to perform this measurement, e.g. the use of two pressure sensors the outputs of which, converted into electric values, are compared and transformed into an electric signal actuating a solenoid valve.

But such devices are complex, due to the need of transforming the pressures into electric signals and of re-converting the electric instruction back into a pressure signal. On the other hand, the conventional piston or membrane devices easily measure a difference between pressures, but not a ratio.

SUMMARY OF THE INVENTION

According to this invention, a device for comparing to a certain threshold the ratio between a first and a second pressures available in two points of a machine processing a liquefiable gas comprises a movable member, a control means connected therewith, means for subjecting the movable member in contrary directions on the one hand to an effort which is proportional to the first pressure and on the other hand to an effort which is proportional to the pressure of a second liquefiable gas which is substantially in balance with its condensate, part at least of which condensate is in a housing adapted to be in thermal contact with a region of the machine where the first liquefiable gas is subjected to the second pressure and is substantially in balance with its condensate, the second liquefiable gas having at a given temperature a vapor pressure which is substantially equal to the first pressure when the pressure ratio equals the threshold. Liquids in pressure equilibrium with their vapour phases have indeed the property that the ratio between the pressures of two such liquids of different nature and subjected to the same temperature varies little in a wide temperature range.

The invention consists in opposing on the movable member on the one side the first pressure of the ratio to be compared with the threshold and on the other side the pressure of a fluid, which pressure, according to the above cited rule, is in a certain known substantially constant ratio $r_o$ with the second pressure of the ratio to be compared. Thereby, the equilibrium of the movable member is theoretically obtained when the first pressure equals the pressure of the said fluid, that is, when the ratio r to be compared with the threshold is equal to $r_o$ which, accordingly, is the said threshold.

According to another object of this invention, a machine, comprising a compressor provided with means for adjusting the compression ratio and adapted to urge a first liquefiable gas from an intake region to an exhaust region, also comprises a device as hereinbefore stated for comparing a pressure ratio to a threshold, which device is connected to the compressor so as to compare to a certain threshold the ratio between the pressure in the exhaust region and the pressure in the intake region, wherein the control means of the comparison device is connected to the compression ratio adjustment means in order to determine a relatively high compression ratio when the exhaust pressure is above a certain threshold with respect to the intake pressure and to determine a relatively low compression ratio in the contrary case.

BRIEF DESCRIPTION OF THE DRAWINGS

This invention will be more readily understood from the description hereinafter and the attached drawings, given as non-limiting example, and wherein.

DETAILED DESCRIPTION

Figure 1:
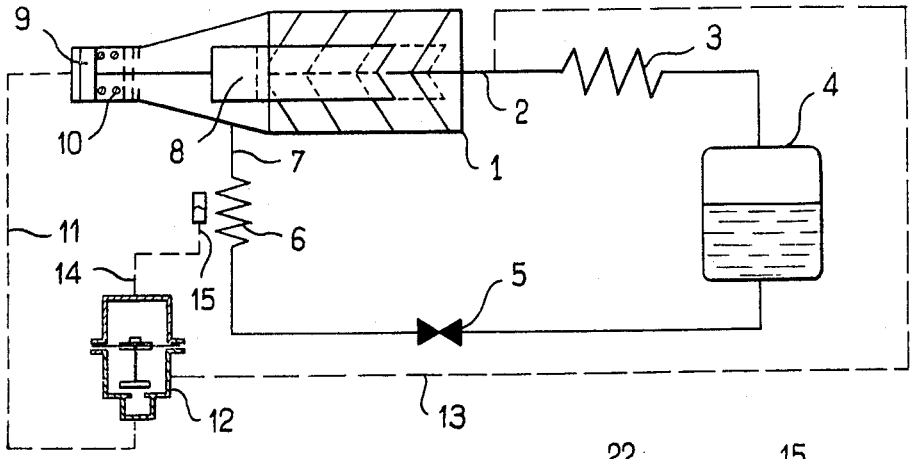
FIG. 1 is a schematic view of a refrigerating system using a sensor according to this invention.

With reference to FIG. 1, a volumetric compressor 1, in the case shown, a twin-screw compressor discharges its high pressure into an exhaust conduit 2 followed by a condenser 3, an accumulating reservoir 4, an expansion valve 5, an evaporator 6, connected in turn to an intake region of the compressor by a conduit 7.

As is known per se, a slide 8 is movable between two stable end-positions, one of which is shown in full lines, the other in dotted lines. When the slide 8 moves from one position to the other position, the point where the exhaust region opens in the compressor, and thus the built-in compression ratio, are modified.

The position of slide 8 is controlled by a piston 9 urged by a spring 10 towards an end position shown in full line and corresponding to the full line position of slide 8. The piston 9 may be moved towards its position shown in dotted lines, corresponding to the dotted lines position of slide 8, if a pressurized fluid is applied to piston 9, in opposition to spring 10, through a conduit 11. Piston 9 is not completely leak-tight, so that, when the pressurized fluid, in the example the gas from the exhaust pipe 2 of the compressor, is cut off, the piston is brought back to its position shown in full lines by the spring 10 and the pressure at the end of the slide.

Communication between exhaust pipe 2 and conduit 11 is controlled by the sensor 12.

The sensor 12 comprises a body 16 innerly divided into two rooms by a membrane 17, capable of being distorted, actuating a control means comprised of an arm 18 and a valve-flap 19 adapted to selectively close an orifice 20 communicating with conduit 11.

On the same side of the membrane 17 as the orifice 20, the cavity in body 16 communicates with a conduit 13 which is in fluid communication with the exhaust pipe 2.

On the other side of the membrane 17, the cavity inside the body 16 communicates via a pipe 14 with a bulb 15 which is in thermal contact with the evaporator 6.

The bulb 15 contains a liquid 21 in pressure equilibrium with its vapour 22.

The liquid 21 is chosen so as to have, at a given temperature, a vapour pressure higher than the vapour pressure of the refrigerant gas that boils in the evaporator 6 and with a ratio $r_o$ with said vapour pressure.

Figure 3:
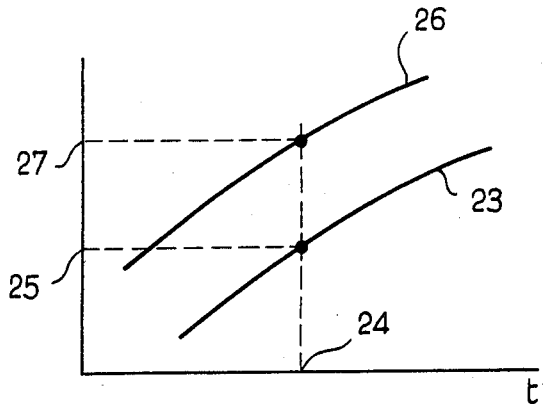
FIG. 3 is a diagram for explaining the invention.

On FIG. 3, have been shown, as abscissae, the evaporator temperature t, and as ordinates the logarithm of the vapour pressures. Curve 23, which corresponds to the liquid in the evaporator 6, indicates for a temperature shown in 24 a pressure p1 shown in 25; curve 26 corresponds to the liquid 21 in the bulb 15 which is subjected to a pressure p2 shown in 27 for the same temperature 24.

It should be noted that when point 24 varies, the distance 25–27 remains substantially constant, i.e. the difference between the logarithms of the pressure is approximately constant, which means that the ratio of the pressures is constant.

If, for example, the fluid in the refrigerating circuit is R114 and if the bulb is filled with R22, the ratio of the pressures is $p2/p1=5.00/0.808=6.18$ at 0° C. and $p2/p1=2.46/0.369=6.66$ at −20° C.

Figure 2:
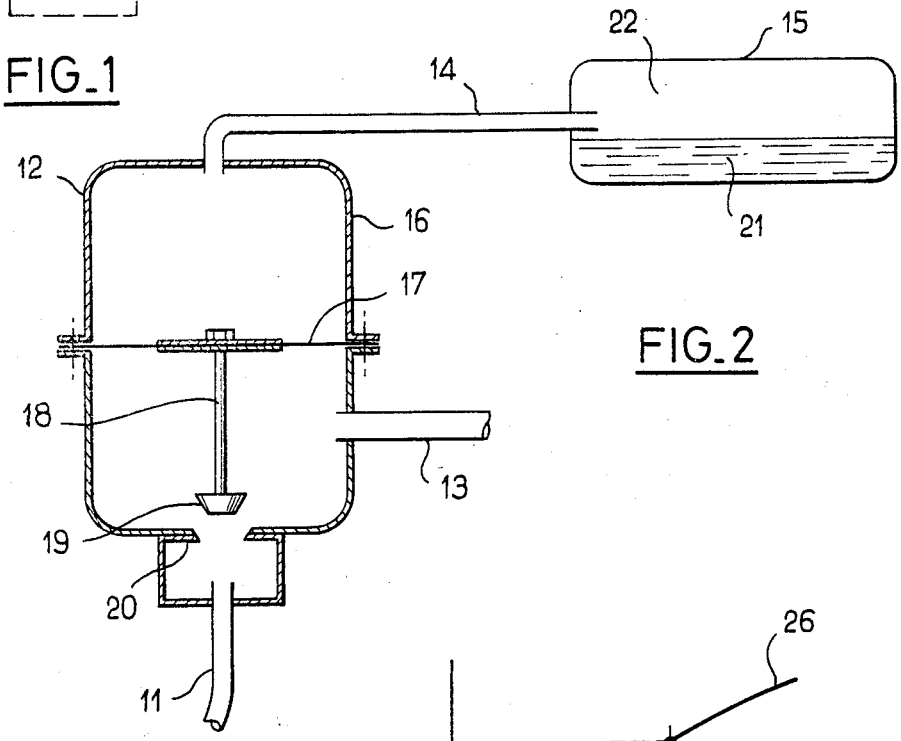
FIG. 2 is a sectional view of the sensor of FIG. 1.

In the temperature range just considered, there thus results that if the exhaust pressure exceeds 6.2 to 6.7 times the intake pressure, the pressure in conduit 13 of FIG. 2 exceeds the pressure supplied by the bulb 15, the membrane moves and lifts the valve 19, so as to apply the high pressure on the piston 9 and make the slide 8 move forward to its dotted line position, so as to increase the built-in compression ratio; if now the pressure decreases, the valve 19 closes again and the slide 8 moves back, reducing the built-in compression ratio so as to adapt the same to the lower system compression ratio.

It is of course possible to fill the bulb 15 not with one liquid, but with a mixture of liquids so as to obtain any desired pressure ratio.

It is indeed known that the pressure of a mixture of liquids is equal to the sum of the vapour part-pressures, which are in turn proportional to the vapour pressure of each fluid and to its molar concentration.

If in the preceding numeric example, one replaces the R22 in the bulb by a mixture of 50% in weight of R22 and 50% of R114, whose respective molecular weights are 86.5 and 170.9, the respective molar concentrations are $50/86.5=0.578$ and $50/170.9=0.292$, which lead to molar ratios in the mixture of $0.578/(0.578+0.292)=0.665$ for the R22, and $0.292/(0.578+0.292)=0.335$ for the R114.

At 0° C., the vapour pressure of the mixture is then $0.665\times5+0.335\times0.808=3.60$ and at −20° C. $0.665\times2.46+0.335\times0.369=1.76$ which leads to following pressure ratios with R114 $3.60/0.808=4.45$ and $1.76/0.369=4.77$.

In the above description, the bulb 15 has been shown in contact with the evaporator; but, bulb 15 can be arranged in any place where the refrigerant boils, for instance at the intake of the compressor 1 if the latter is not oil-injected but refrigerant-injected; liquid refrigerant is then present at intake.

Also, in lieu of a membrane 17, one could have used a tight piston, or a bellows, inasmuch as the technique used avoids any loss of the liquid 21 or of its vapour.

I claim:

1. A machine for processing a liquefiable gas, comprising a compressor provided with compression ratio adjustment means for changing over the compression ratio from a first, relatively low predetermined value to a second, relatively high predetermined value and conversely, said compressor being adapted to urge a first liquefiable gas from an intake region towards an exhaust region, and a device for comparing to a certain threshold value the ratio between an exhaust pressure, existing in said exhaust region, and an intake pressure, existing in said intake region, said device including a movable member, control means connected with said movable member, means for subjecting said movable member to a force which is proportional to the exhaust pressure and tends to move said movable member in a first direction, and on the other hand to a force which is proportional to the pressure of a second liquefiable gas which tends to move said movable member in a direction contrary to said first direction and is substantially in balance with its condensate, part at least of which condensate is in a housing adapted to be in thermal contact with a portion of the intake region where the first liquefiable gas is substantially in balance with its condensate, the second liquefiable gas having at a given temperature a vapor pressure which is substantially equal to said exhaust pressure when the pressure ratio equals the threshold value, wherein the control means of said device is operably connected to said compression ratio adjustment means in order to adjust the compression ratio to its first, relatively low, predetermined value when the exhaust pressure is below the threshold value with respect to the intake pressure, and to adjust the compression ratio to its second, relatively high, predetermined value, when the exhaust pressure is above the threshold value with respect to the intake pressure, and wherein the movable member has a surface subjected to the exhaust pressure in a casing, and wherein the control means includes a valve member adapted to control communication through the casing between a conduit means connected to the exhaust region and a conduit means connected to a device adapted to actuate the compression ratio adjustment means.

2. A machine according to claim 1, wherein the machine is a refrigerating machine having an evaporator, and said intake region includes said evaporator, said housing being in thermal contact with said evaporator.

3. A machine for processing a liquefiable gas, comprising a compressor provided with compression ratio adjustment means for changing over the compression ratio from a first, relatively low predetermined value to a second, relatively high predetermined value and conversely, said compressor being adapted to urge a first liquefiable gas from an intake region towards an exhaust region, and a device for comparing to a certain threshold value the ratio between an exhaust pressure, existing in said exhaust region, and an intake pressure, existing in said intake region, said devices including a movable member, control means connected with said movable member, means for subjecting said movable member exclusively to a variable force which is proportional to the exhaust pressure and tends to move said movable member in a first direction, and on the other hand exclusively to a variable force which is proportional to the pressure of a second liquefiable gas which tends to move said movable member in a direction contrary to said first direction and is substantially in balance with its condensate, part at least of which condensate is in a housing adapted to be in thermal contact with a portion of the intake region where the first liquefiable gas is substantially in balance with its condensate, the second liquefiable gas having at a given temperature a vapor pressure which is substantially equal to said exhaust pressure when the pressure ratio equals the threshold value, wherein the control means of said device is operably connected to said compression ratio adjustment means in order to adjust the compression ratio to its first, relatively low, predetermined value when the exhaust pressure is below the threshold value with respect to the intake pressure, and to adjust the compression ratio to its second, relatively high, predetermined value, when the exhaust pressure is above the threshold value with respect to the intake pressure.

* * * * *